US010508556B2

(12) United States Patent
Drozdenko et al.

(10) Patent No.: US 10,508,556 B2
(45) Date of Patent: Dec. 17, 2019

(54) ROTOR BLADE ROOT SPACER WITH GRIP ELEMENT

(71) Applicant: United Technologies Corporation, Hartford, CT (US)

(72) Inventors: Lee Drozdenko, Bristol, CT (US); James H. Moffitt, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 806 days.

(21) Appl. No.: 14/761,841

(22) PCT Filed: Jan. 17, 2013

(86) PCT No.: PCT/US2013/021935
§ 371 (c)(1),
(2) Date: Jul. 17, 2015

(87) PCT Pub. No.: WO2014/113009
PCT Pub. Date: Jul. 24, 2014

(65) Prior Publication Data

US 2015/0361805 A1 Dec. 17, 2015

(51) Int. Cl.
*F01D 5/32* (2006.01)
*F01D 5/30* (2006.01)
(Continued)

(52) U.S. Cl.
CPC ..... *F01D 5/326* (2013.01); *B25B 7/02* (2013.01); *B25B 7/08* (2013.01); *F01D 5/02* (2013.01); *F01D 5/12* (2013.01); *F01D 5/30* (2013.01); *F01D 5/3007* (2013.01); *F01D 5/3092* (2013.01); *F01D 15/12* (2013.01); *F01D 25/285* (2013.01); *F05D 2220/30* (2013.01)

(58) Field of Classification Search
CPC ..... F01D 15/12; F01D 25/285; F01D 5/02; F01D 5/12; F01D 5/30; F01D 5/3007; F01D 5/3092; F01D 5/326; F05D 2220/30; B25B 7/02; B25B 7/08
USPC ..... 416/220 R, 221, 248
See application file for complete search history.

(56) References Cited

U.S. PATENT DOCUMENTS 3,216,699 A 11/1965 Schoenborn
3,572,970 A 3/1971 Smuland
(Continued)

FOREIGN PATENT DOCUMENTS

DE 19823157 11/1999

OTHER PUBLICATIONS

EP Search Report dated Feb. 10, 2016.

*Primary Examiner* — Mark A Laurenzi
*Assistant Examiner* — Paul W Thiede
(74) *Attorney, Agent, or Firm* — O'Shea Getz P.C.

(57) ABSTRACT

An assembly includes a rotor disk, a rotor blade and a root spacer. The rotor disk includes a slot that extends longitudinally into the rotor disk. The rotor blade includes a blade root arranged within the slot. The root spacer is arranged with the slot between the rotor disk and the blade root. The root spacer extends longitudinally to a spacer end, and includes a grip element and a plurality of notches. The grip element is arranged at the spacer end laterally between the notches. The grip element at least partially defines the notches. The notches extend radially and longitudinally into the root spacer.

15 Claims, 6 Drawing Sheets

(51) Int. Cl.

| | |
|---|---|
| ***F01D 25/28*** | (2006.01) |
| ***F01D 5/02*** | (2006.01) |
| ***F01D 5/12*** | (2006.01) |
| ***B25B 7/02*** | (2006.01) |
| ***B25B 7/08*** | (2006.01) |
| ***F01D 15/12*** | (2006.01) |

(56) References Cited

U.S. PATENT DOCUMENTS

| | | | | |
|---|---|---|---|---|
| 3,653,781 | A | 4/1972 | Cooper | |
| 3,936,234 | A | 2/1976 | Tucker et al. | |
| 4,265,595 | A | 5/1981 | Bucy, Jr. et al. | |
| 4,474,535 | A * | 10/1984 | Dhuic | F01D 5/323 416/220 R |
| 5,123,813 | A | 6/1992 | Przytulski et al. | |
| 5,350,279 | A | 9/1994 | Prentice et al. | |
| 5,431,543 | A | 7/1995 | Brown et al. | |
| 5,501,575 | A | 3/1996 | Eldredge et al. | |
| 5,820,347 | A | 10/1998 | Bussonnett et al. | |
| 6,223,616 | B1 | 5/2001 | Sheridan | |
| 6,447,253 | B2 | 9/2002 | Tempere | |
| 6,481,971 | B1 | 11/2002 | Forrester | |
| 6,773,234 | B2 | 8/2004 | Sinha et al. | |
| 6,846,159 | B2 | 1/2005 | Zabawa et al. | |
| 6,951,448 | B2 | 10/2005 | Duesler et al. | |
| 7,108,484 | B2 | 9/2006 | Thenaisie et al. | |
| 7,153,098 | B2 | 12/2006 | Zabawa | |
| 7,198,463 | B2 * | 4/2007 | Kanebako | F01D 5/081 415/175 |
| 7,334,996 | B2 * | 2/2008 | Corbin | F01D 5/3007 416/221 |
| 7,591,754 | B2 | 9/2009 | Duong | |
| 7,824,305 | B2 | 11/2010 | Duong | |
| 7,926,260 | B2 | 4/2011 | Sheridan et al. | |
| 8,205,432 | B2 | 6/2012 | Sheridan | |
| 8,257,024 | B1 | 9/2012 | Phillips et al. | |
| 2005/0129522 | A1 | 6/2005 | Kite et al. | |
| 2005/0254951 | A1 | 11/2005 | Thenaisie et al. | |
| 2006/0165530 | A1 | 7/2006 | Corbin et al. | |
| 2009/0004017 | A1 | 1/2009 | Belmonte et al. | |
| 2010/0189564 | A1 | 7/2010 | Stone | |
| 2011/0211967 | A1 | 9/2011 | Deal et al. | |
| 2011/0223027 | A1 | 9/2011 | Klinetob et al. | |
| 2011/0229334 | A1 | 9/2011 | Alexander | |
| 2011/0305576 | A1 | 12/2011 | Ward et al. | |
| 2012/0107125 | A1 | 5/2012 | Reghezza et al. | |

* cited by examiner

ROTOR BLADE ROOT SPACER WITH GRIP ELEMENT

This application claims priority to PCT Patent Application No. PCT/US13/21935 filed Jan. 17, 2013, which is hereby incorporated by reference.

BACKGROUND OF THE INVENTION

1. Technical Field

This disclosure relates generally to rotational equipment and, more particularly, to a root spacer for arranging between a rotor disk and a root of a rotor blade.

2. Background Information

A fan assembly for a typical turbine engine includes a plurality of fan blades arranged circumferentially around a rotor disk. Each of the fan blades includes an airfoil connected to a dovetail root. The root is inserted into a respective dovetail slot within the rotor disk, and connects the fan blade to the rotor disk. A radial height of the root is typically less than a radial height of the slot. A gap therefore extends between a radial inner surface of the root and a radial inner surface of the rotor disk within the slot. Such a gap is typically filled with a root spacer, which is sometimes also referred to as a fan blade spacer.

A typical root spacer is configured to reduce slippage and wear between the root and the rotor disk where centrifugal loading on the fan blade is relatively low; e.g., during wind milling. By filling the gap, for example, the root spacer reduces space that would otherwise be available for rotating of the root within the slot.

Various types and configurations of root spacers are known in the art. One such root spacer includes a threaded hole that extends into an end of the spacer. During engine maintenance, a tool with a threaded shaft is threaded into the hole and manipulated to pull the root spacer from the slot. The root spacer therefore has a relatively large radial thickness in order to accommodate the threaded hole. Such a relatively large radial thickness may increase the overall size and/or weight of the fan assembly as well as take away space that would otherwise be available for a larger blade root.

There is a need in the art for an improved root spacer.

SUMMARY OF THE DISCLOSURE

According to an aspect of the invention, an assembly is provided that includes a rotor disk, a rotor blade and a root spacer. The rotor disk includes a slot that extends longitudinally into the rotor disk. The rotor blade includes a blade root arranged within the slot. The root spacer is arranged with the slot between the rotor disk and the blade root. The root spacer extends longitudinally to a spacer end, and includes a grip element and a plurality of notches. The grip element is arranged at the spacer end laterally between the notches, and at least partially defines the notches. The notches extend radially and longitudinally into the root spacer, and at least one of the notches extends laterally within the root spacer.

According to another aspect of the invention, another assembly is provided that includes a rotor disk, a rotor blade and a root spacer. The rotor disk includes a slot that extends longitudinally into the rotor disk. The rotor blade includes a blade root arranged within the slot. The blade root extends longitudinally to a root end. The root spacer is arranged with the slot between the rotor disk and the blade root. The root spacer extends longitudinally to a spacer end that is approximately longitudinally aligned with the root end. The root spacer includes a grip element and a plurality of notches. The grip element is arranged at the spacer end laterally between the notches, and at least partially defines the notches. The notches extend radially and longitudinally into the root spacer.

A first of the notches may extend laterally within the root spacer. Alternatively, each of the notches may extend laterally within the root spacer.

A first of the notches may extend laterally into the root spacer. Alternatively, each of the notches may extend laterally into the root spacer.

A first of the notches may extend radially through the root spacer. Alternatively, each of the notches may extend radially through the root spacer.

A first of the notches may extend radially into the root spacer to a surface. Alternatively, each of the notches may extend radially into the root spacer to a surface.

The grip element may include a base and a flange that extends laterally from the base. The base and the flange may at least partially define a first of the notches. The flange may be a first flange, and the grip element may also include a second flange that extends laterally from the base. The base may be arranged laterally between the first and the second flanges. The base and the second flange may at least partially define a second of the notches.

The grip element may extend longitudinally to the spacer end. Alternatively, the grip element may be longitudinally recessed from the spacer end.

The slot may extend longitudinally into the rotor disk from a disk end. The spacer end may be arranged at the disk end. Alternatively, the spacer end may be approximately longitudinally aligned with the disk end.

The blade root may extend longitudinally to a root end. The spacer end may be approximately longitudinally aligned with the root end.

The slot may be one of a plurality of slots that extend longitudinally into the rotor disk. The rotor blade may be one of a plurality of rotor blades arranged circumferentially around an axis. Each of the rotor blades may include a blade root arranged within a respective one of the slots. The root spacer may be one of a plurality of root spacers. Each of the root spacers may be arranged within a respective one of the slots between the rotor disk and a respective one of the blade roots. At least some or all of the root spacers each include a grip element.

The rotor blade may be configured as or include a turbine engine fan blade. Alternatively, the rotor blade may be configured as or include any other type of turbine engine blade.

The assembly may include a gear train and a plurality of turbine engine rotors arranged along an axis. The engine rotors may include a first rotor and a second rotor. One of the engine rotors may include the rotor disk, the rotor blade and the root spacer. The gear train may connect the first rotor to the second rotor. The first rotor may be configured as or include a fan rotor, and may include the rotor disk, the rotor blade and the root spacer.

The foregoing features and the operation of the invention will become more apparent in light of the following description and the accompanying drawings.

DETAILED DESCRIPTION OF THE INVENTION

Figure 1:
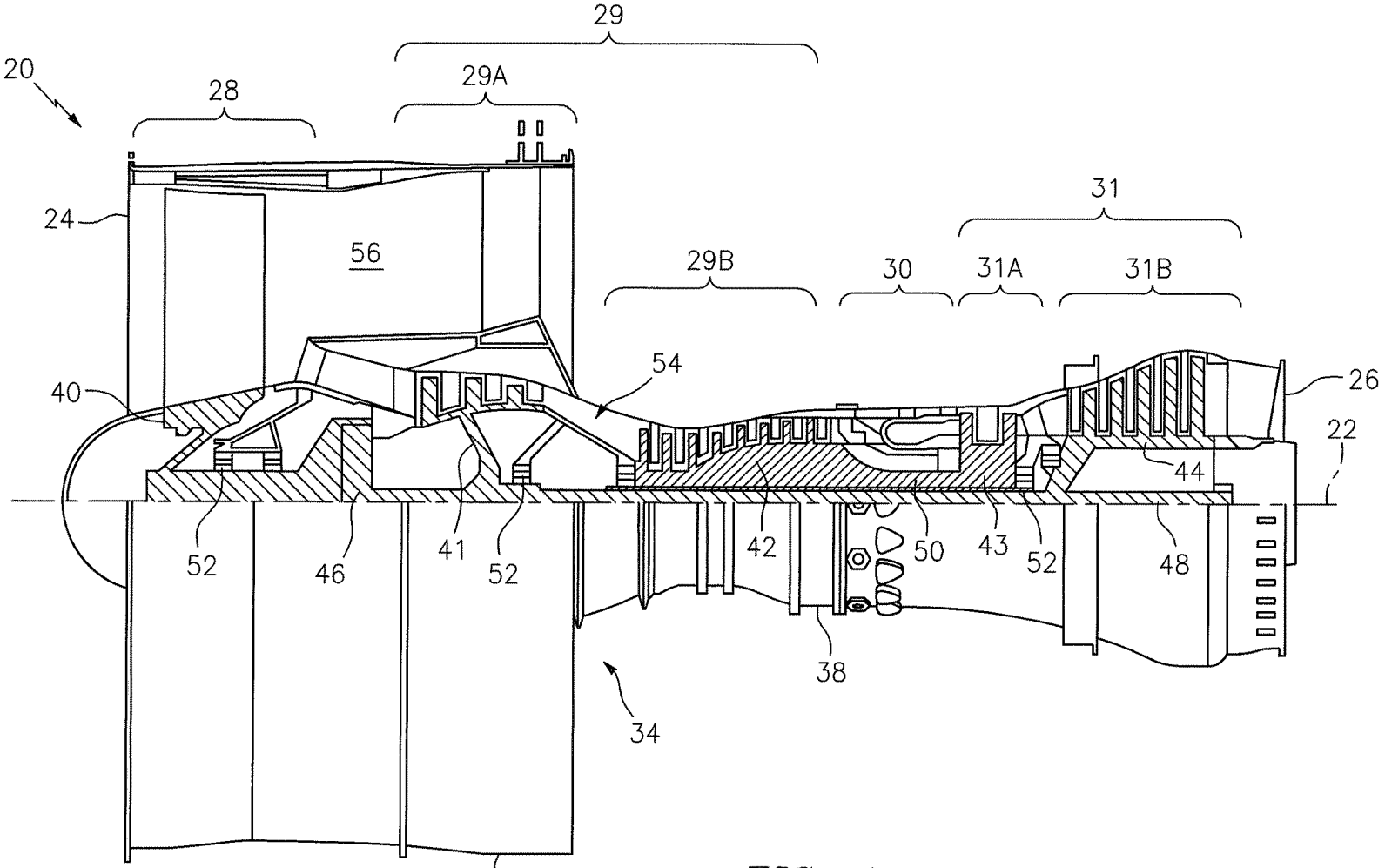
FIG. 1 is a side cutaway illustration of a geared turbine engine.

FIG. 1 is a side cutaway illustration of a geared turbine engine 20 that extends along an axis 22 between an upstream airflow inlet 24 and a downstream airflow exhaust 26. The engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the axis 22 within an engine housing 34, which includes a first engine case 36 (e.g., a fan nacelle) and a second engine case 38 (e.g., a core nacelle).

Each of the engine sections 28, 29A, 29B, 31A and 31B includes a respective rotor 40-44. Each of the rotors 40-44 includes a plurality of rotor blades arranged circumferentially around and connected to (e.g., formed integral with or mechanically fastened, welded, brazed or otherwise adhered to) one or more respective rotor disks. The fan rotor 40 is connected to a gear train 46; e.g., an epicyclic gear train. The gear train 46 and the LPC rotor 41 are connected to and driven by the LPT rotor 44 through a low speed shaft 48. The HPC rotor 42 is connected to and driven by the HPT rotor 43 through a high speed shaft 50. The low and high speed shafts 48 and 50 are rotatably supported by a plurality of bearings 52. Each of the bearings 52 is connected to the second engine case 38 by at least one stator such as, for example, an annular support strut.

Air enters the engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air" or "cooling air". The core air is directed through the engine sections 29-31 and exits the engine 20 through the airflow exhaust 26. Within the combustion section 30, fuel is injected into and mixed with the core air and ignited to provide forward engine thrust. The bypass air is directed through the bypass gas path 56 and out of the engine 20 to provide additional forward engine thrust or reverse thrust via a thrust reverser. The bypass air may also be utilized to cool various turbine engine components within one or more of the engine sections 29-31.

Figure 2:
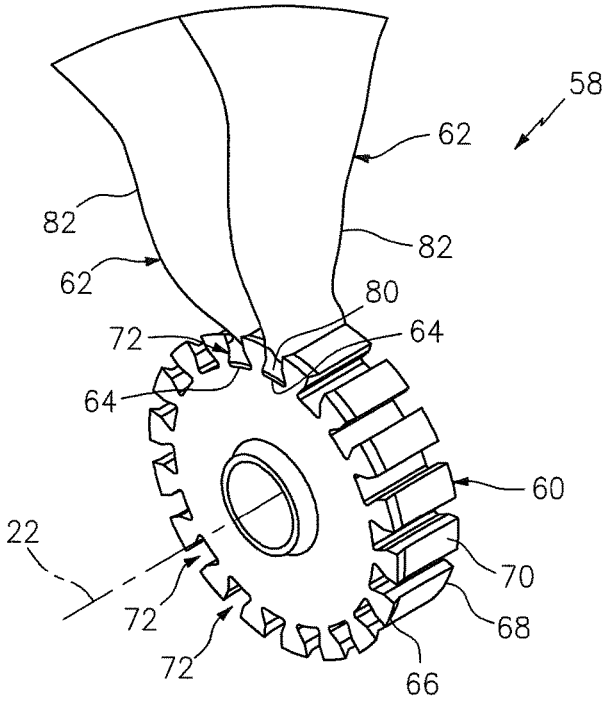
FIG. 2 is a perspective illustration of a partially assembled rotor assembly.

FIG. 2 is a perspective illustration of a partially assembled rotor assembly 58 for one of the rotors 40-44; e.g., the fan rotor 40. This rotor assembly 58 includes a rotor disk 60, one or more rotor blades 62 (e.g., fan blades), and one or more root spacers 64 (e.g., fan blade spacers).

Figure 3:
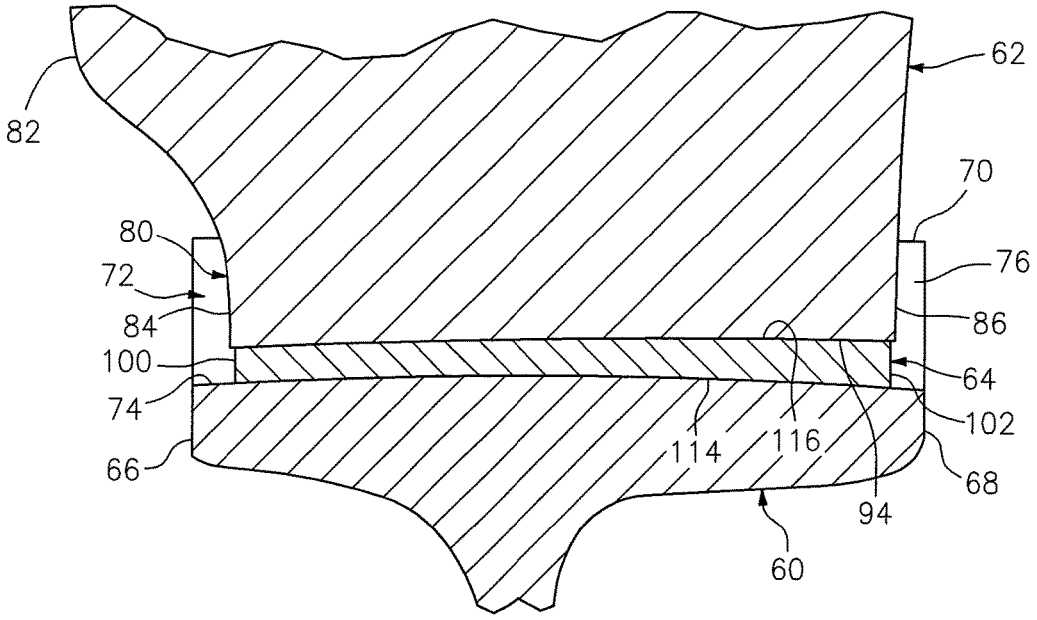
FIG. 3 is a side sectional illustration of a portion of the rotor assembly of FIG. 2.
Figure 4:
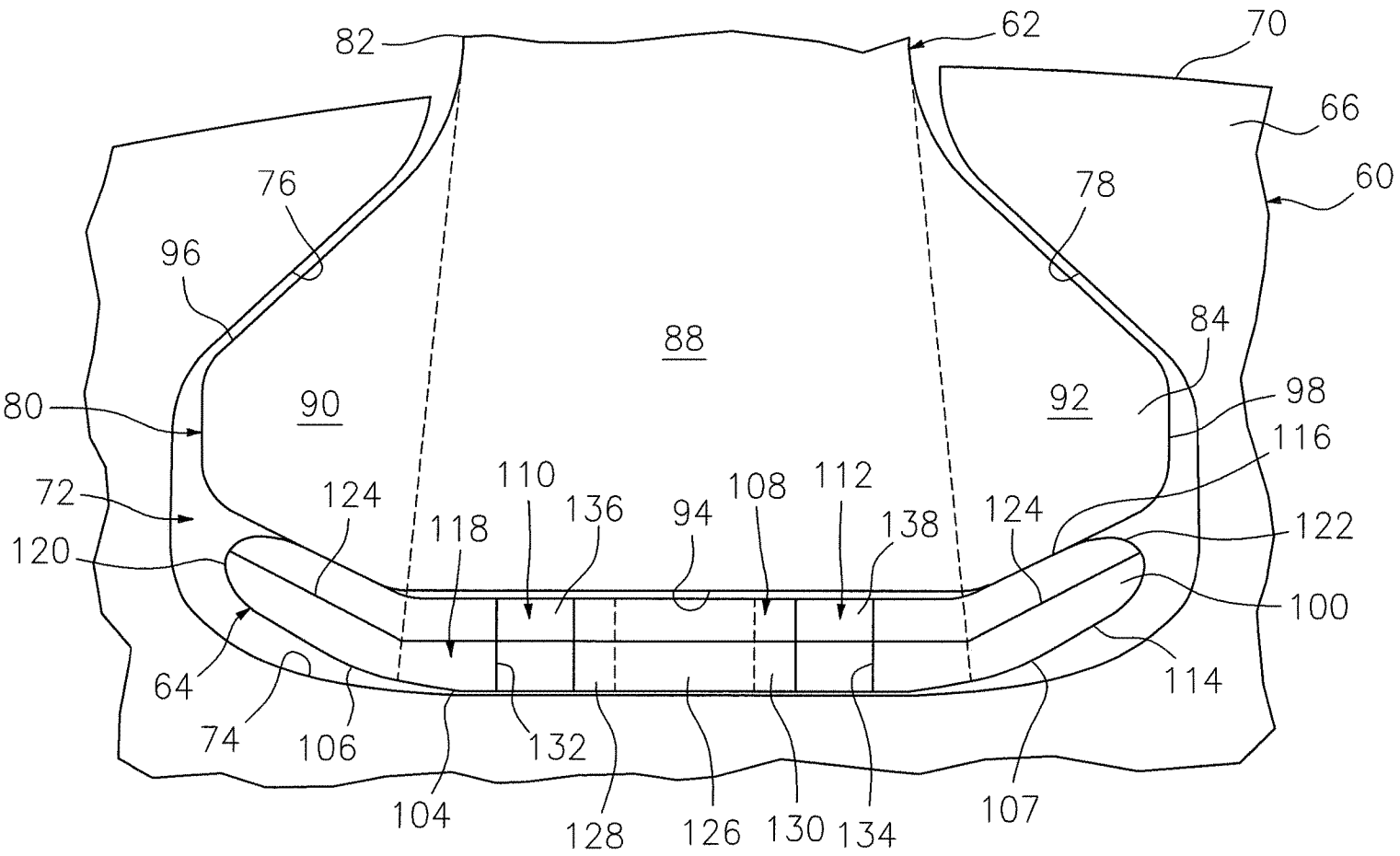
FIG. 4 is a partial illustration of an end of the rotor assembly of FIG. 2.

The rotor disk 60 extends axially along the axis 22 between an upstream disk end 66 and a downstream disk end 68. The rotor disk 60 extends radially out to a disk outer surface 70. The rotor disk 60 includes one or more slots 72 (e.g., dovetail slots) arranged circumferentially around the axis 22. Referring to FIG. 3, one or more of the slots 72 each extends longitudinally (e.g., axially) into the rotor disk 60; e.g., through the rotor disk 60 between the disk ends 66 and 68. Referring now to FIG. 4, one or more of the slots 72 each extends radially into the rotor disk 60 from the outer surface 70 to a slot base surface 74. One or more of the slots 72 each extends laterally (e.g., circumferentially or tangentially) between opposing slot side surfaces 76 and 78. The base surface 74 extends laterally between the side surfaces 76 and 78.

Referring to FIG. 3, one or more of the rotor blades 62 each includes a blade root 80 and an airfoil 82. The blade root 80 extends longitudinally between an upstream root end 84 and a downstream root end 86. Referring now to FIG. 4, the blade root 80 includes a root base portion 88 and a pair of root side portions 90 and 92. The base portion 88 extends radially between the airfoil 82 and a root base surface 94. The side portions 90 and 92 respectively extend laterally from the base portion 88 to opposing root side surfaces 96 and 98. The base surface 94 extends laterally between the side surfaces 96 and 98.

Figure 5:
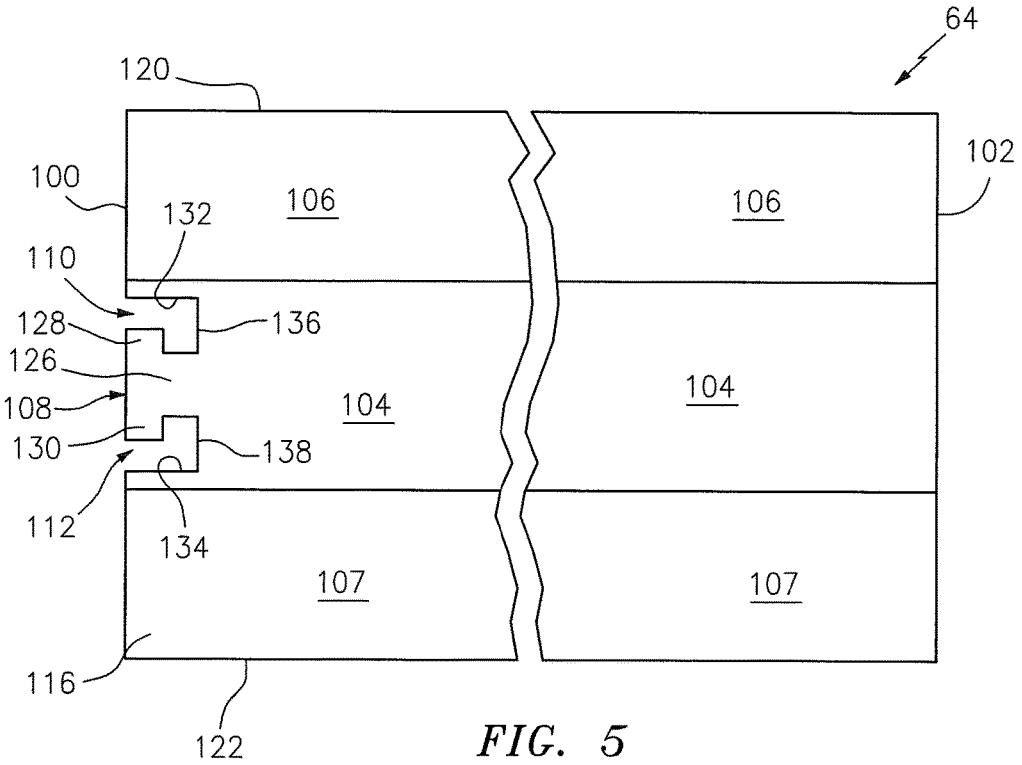
FIG. 5 is an illustration of a root spacer for the rotor assembly of FIG. 2.
Figure 6:
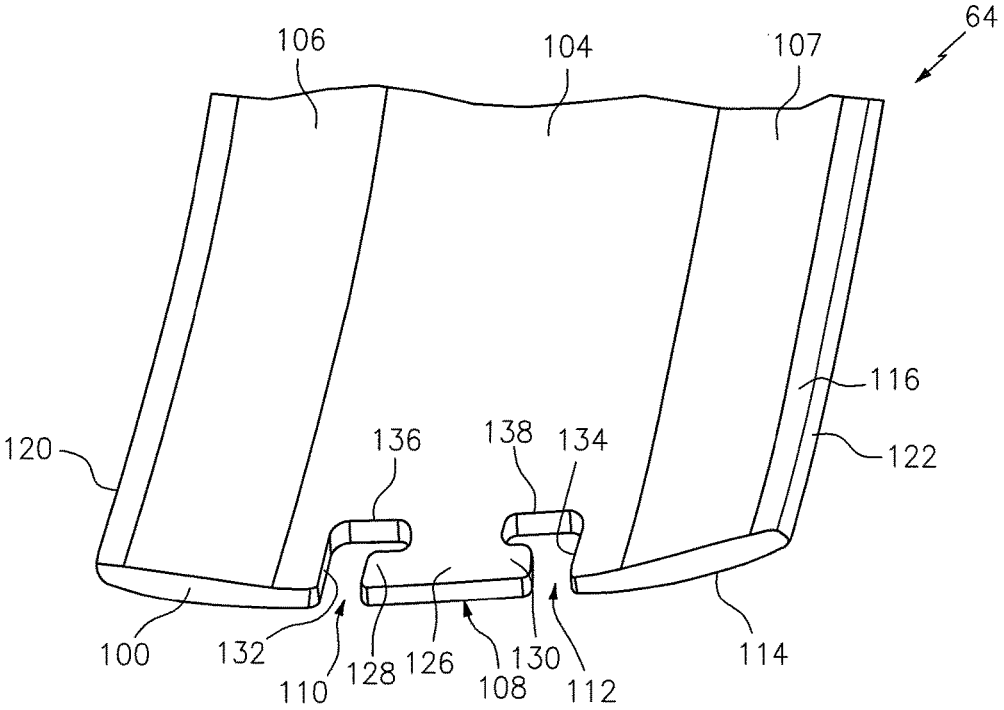
FIG. 6 is a perspective illustration of an end portion of the root spacer of FIG. 5.

Referring to FIGS. 4 to 6, one or more of the root spacers 64 each extends longitudinally between an upstream spacer end 100 and a downstream spacer end 102. One or more of the root spacers 64 each includes a spacer base portion 104, one or more spacer side portions 106 and 107, a grip element 108 (e.g., a T-shaped protrusion), and one or more notches 110 and 112 (e.g., L-shaped channels). The base and the side portions 104, 106 and 107 extend radially between a spacer inner surface 114 and a spacer outer surface 116. The base portion 104 extends laterally between the side portions 106 and 107, and has a chord 118 (see FIG. 4). The side portions 106 and 107 respectively extend laterally from the base portion 104 to opposing spacer sides 120 and 122. Each of the side portions 106 and 107 has a chord 124 (see FIG. 4) that may be angularly offset from the chord 118 by, for example, between about 135 and about 160 degrees.

Figure 7:
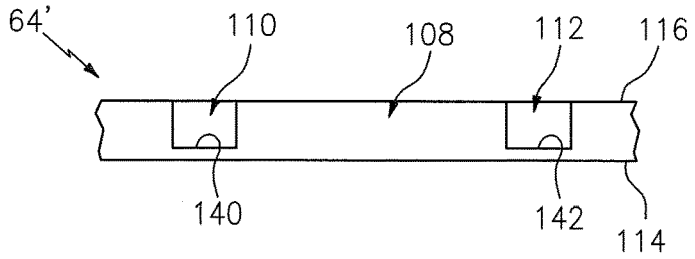
FIG. 7 is a partial illustration of an end of another root spacer for the rotor assembly of FIG. 2.

Referring to FIGS. 5 and 6, the grip element 108 is arranged at (e.g., adjacent, proximate or on) the spacer end 100 laterally between the notches 110 and 112. The grip element 108 includes a base 126 and one or more flanges 128 and 130. The base 126 extends longitudinally to the spacer end 100, and is arranged laterally between the flanges 128 and 130. The flanges 128 and 130 respectively extend laterally from the base 126 to opposing grip sides. The base 126 and the first flange 128 at least partially define the first notch 110. The first notch 110, for example, extends laterally within the root spacer 64 between a notch first side surface 132 of the base portion 104 and the base 126 and the first flange 128. The base 126 and the second flange 130 at least partially define the second notch 112. The second notch 112, for example, extends laterally within the root spacer 64 between a notch second side surface 134 of the base portion 104 and the base 126 and the second flange 130. The notches 110 and 112 respectively extend longitudinally into the root spacer 64 to notch end surfaces 136 and 138 of the base portion 104. One or more of the notches 110 and 112 extend radially through the root spacer 64 between the inner surface 114 and the outer surface 116, which may enable the root spacer 64 to have a relatively thin radial thickness. Alternatively, referring to FIG. 7, one or more of the notches 110 and 112 may respectively extend radially into the root spacer 64' to notch inner surfaces 140 and 142 (or notch outer surfaces).

Referring to FIG. 2, the rotor blades 62 are arranged circumferentially around the axis 22. The blade roots 80 and the root spacers 64 are respectively arranged within the slots 72. Referring to FIG. 3, the spacer end 100 and the root end 84 may be substantially longitudinally aligned and/or respective arranged at the disk end 66. Alternatively, the spacer end 100 and/or the root end 84 may be substantially longitudinally aligned with the disk end 66. The spacer end 102 and the root end 86 may also or alternatively be substantially longitudinally aligned and/or respective arranged at the disk end 68. Alternatively, the spacer end 102 and/or the root end 86 may be substantially longitudinally aligned with the disk end 68. Referring to FIG. 4, the root side portions 90 and 92 extend laterally between the root base portion 88 and the rotor disk 60. The root side surfaces 96 and 98 may respectively engage (e.g., contact) the slot side surfaces 76 and 78. The root spacer 64 is arranged radially between the blade root 80 and the rotor disk 60. The spacer outer surface 116 may engage one or more of the surfaces 94, 96 and 98, and/or the spacer inner surface 114 may engage the slot base surface 74.

Figure 8:
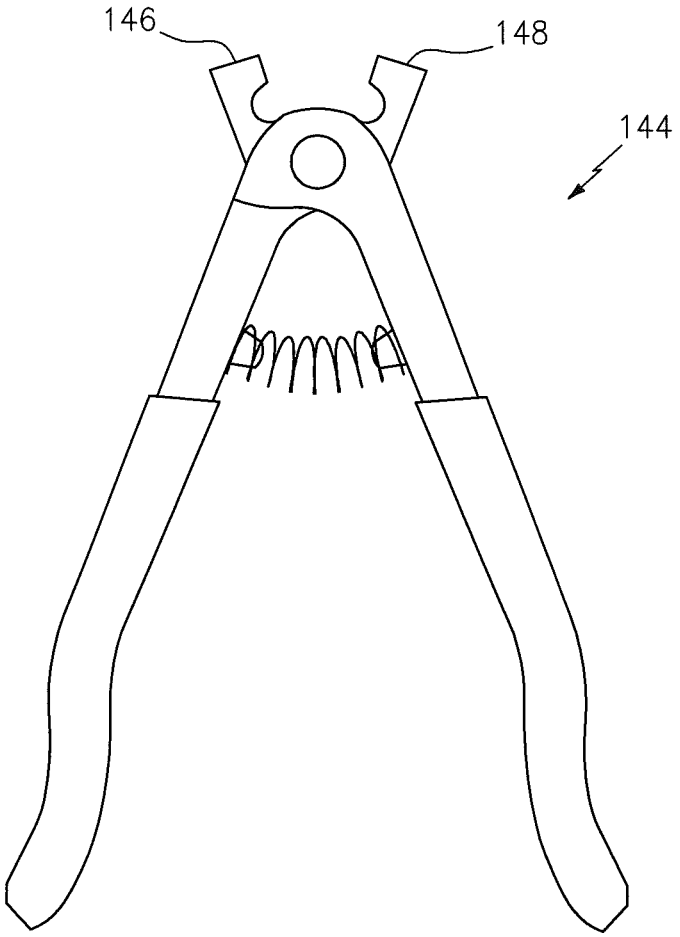
FIG. 8 is an illustration of a tool for removing a root spacer from a slot of a rotor disk.

Referring to FIGS. 4, 6 and 8, a tool 144 with clamping grip members 146 and 148 may be mated with the grip element 108 during engine maintenance to remove the root spacer 64 from a respective slot 72. The grip members 146 and 148, for example, may be respectively inserted into the notches 110 and 112 and clamped against the grip base 126. The tool 144 may subsequently be manipulated to longitudinally pull the root spacer 64 out of the slot 72. One or more of the grip members 146 and 148 may be coated with a soft material such as rubber to provide a buffer between the grip members 146 and 148 and the blade root 80 and/or the rotor disk 60. One or more of the grip members 146 and 148 may also or alternatively be coated with various other materials, or may be uncoated.

Figure 9:
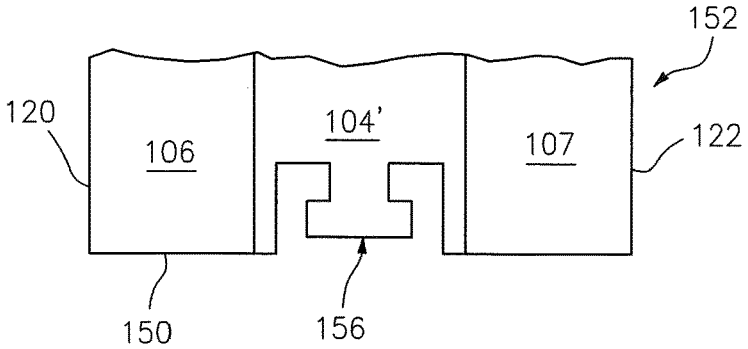
FIG. 9 is an illustration of an end portion of another root spacer for the rotor assembly of FIG. 2.

FIG. 9 illustrates an end 150 of another root spacer 152 for the rotor assembly 58 of FIG. 2. In contrast to the root spacer 64 of FIG. 5, a grip element 156 of the root spacer 152 is longitudinally recessed from the spacer end 150.

Figure 10:
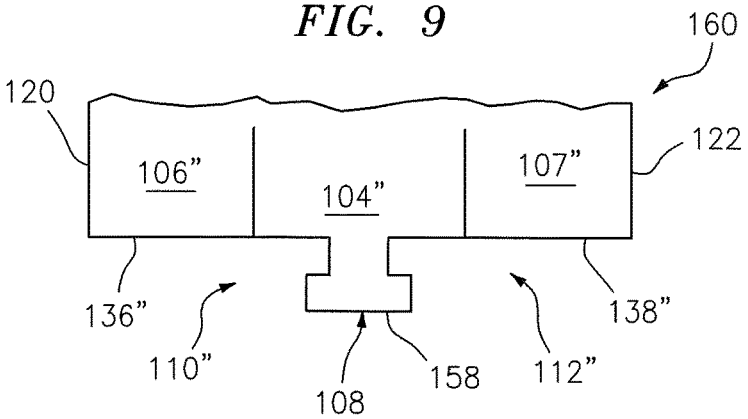
FIG. 10 is an illustration of an end portion of another root spacer for the rotor assembly of FIG. 2.

FIG. 10 illustrates an end 158 of another root spacer 160 for the rotor assembly 58 of FIG. 2. In contrast to the root spacer 64 of FIG. 5, one or more of the notches 110" and 112" of the root spacer 160 extends laterally into the root spacer 160. The first notch 110", for example, extends laterally through the side portion 106" and into the base portion 104" to the grip element 108. The second notch 112" extends laterally through the side portion 107" and into the base portion 104" to the grip element 108. The notch end surfaces 136" and 138" therefore respectively form end surfaces of the side portions 106" and 107".

Figure 11:
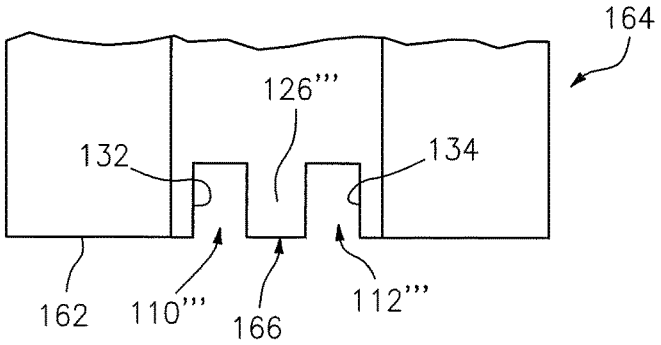
FIG. 11 is an illustration of an end portion of another root spacer for the rotor assembly of FIG. 2.

FIG. 11 illustrates an end 162 of another root spacer 164 for the rotor assembly 58 of FIG. 2. In contrast to the root spacer 64 of FIG. 5, a grip element 166 of the root spacer 164 is configured without the flanges 128 and 130 shown in FIGS. 5 and 6. The notches 110''' and 112''' therefore are respectively laterally defined between the side surfaces 132 and 134 and the base 126'''.

In some embodiments, one or more of the root spacers may be constructed from a polymeric material such as plastic. In other embodiments, one or more of the root spacers may be constructed from metal. The present invention, however, is not limited to any particular root spacer materials.

The slots, the blade roots, the root spacers, the grip elements and the notches may have various configurations other than those described above and illustrated in the drawings. For example, the root spacer may include one or more channels, slots, dimples, through-holes, etc. that may reduce the weight of the root spacer and/or conform to an alternate embodiment root and/or slot configuration. The grip member may be configured as an L-shaped protrusion, or any other type of protrusion. The notches may be defined by one or more arcuate surfaces. The present invention therefore is not limited to any particular rotor disk, rotor blade or root spacer types or configurations.

The terms "upstream", "downstream", "inner" and "outer" are used to orientate the components of the rotor assembly described above relative to the turbine engine and its axis. A person of skill in the art will recognize, however, one or more of these components may be utilized in other orientations than those described above. For example, the grip element may be arranged at the downstream end of the rotor disk. The present invention therefore is not limited to any particular rotor assembly spatial orientations.

A person of skill in the art will recognize the rotor assembly may be included in various turbine engines other than the one described above as well as in other types of rotational equipment. The rotor assembly, for example, may be included in a geared turbine engine where a gear train connects one or more shafts to one or more rotors in a fan section and/or a compressor section. Alternatively, the rotor assembly may be included in a turbine engine configured without a gear train. The rotor assembly may be included in a turbine engine configured with a single spool, with two spools as illustrated in FIG. 1, or with more than two spools. The present invention therefore is not limited to any particular types or configurations of turbine engines or rotational equipment.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An assembly with an axis, comprising:

a rotor disk including a slot that extends axially into the rotor disk;

a rotor blade including a blade root arranged within the slot; and a root spacer arranged with the slot between the rotor disk and the blade root, the root spacer extending axially to a spacer end and including a grip element and a plurality of notches;

wherein the grip element is arranged at the spacer end circumferentially between the notches, and at least partially defines the notches;

wherein at least one of the notches has an open end at the spaces end positioned intermediate outbound edges of the root spacer and the at least one of the notches extends radially and axially into the root spacer and one of the notches extends circumferentially within the root spacer;

wherein the grip element includes a base and a flange that extends circumferentially from the base; and wherein the base and the flange at least partially define a first one of the notches.

2. The assembly of claim 1, wherein each of the notches extends circumferentially within the root spacer.

3. The assembly of claim 1, wherein a first one of the notches extends radially through the root spacer.

4. The assembly of claim 1, wherein a first one of the notches extends radially into the root spacer to a surface.

5. The assembly of claim 1, wherein the flange comprises a first flange, and the grip element further includes a second flange that extends circumferentially from the base;

the base is arranged circumferentially between the first flange and the second flange; and the base and the second flange at least partially define a second one of the notches.

6. The assembly of claim 1, wherein the grip element is axially recessed from the spacer end.

7. The assembly of claim 1, wherein the slot extends axially into the rotor disk from a disk end; and the spacer end is arranged at the disk end.

8. The assembly of claim 1, wherein the blade root extends axially to a root end; and the spacer end is approximately axially aligned with the root end.

9. The assembly of claim 1, wherein the slot is one of a plurality of slots that extend axially into the rotor disk;

the rotor blade is one of a plurality of rotor blades arranged circumferentially around the axis, and each of the rotor blades includes a blade root arranged within a respective one of the slots; and the root spacer is one of a plurality of root spacers, each of the root spacers is arranged within a respective one of the slots between the rotor disk and a respective one of the blade roots, and at least a plurality of the root spacers each include a grip element.

10. The assembly of claim 1, wherein the rotor blade comprises a turbine engine fan blade.

11. The assembly of claim 1, further comprising:

a plurality of turbine engine rotors arranged along the axis and including a first rotor and a second rotor, wherein one of the engine rotors includes the rotor disk, the rotor blade and the root spacer; and a gear train that connects the first rotor to the second rotor.

12. The assembly of claim 11, wherein the first rotor comprises a fan rotor that includes the rotor disk, the rotor blade and the root spacer.

13. An assembly with an axis, comprising:

a rotor disk including a slot that extends axially into the rotor disk;

a rotor blade including a blade root arranged within the slot; and a root spacer arranged with the slot between the rotor disk and the blade root, the root spacer extending axially to a spacer end and including a grip element and a plurality of notches;

wherein the grip element is arranged at the spacer end circumferentially between the notches, and at least partially defines the notches;

wherein at least one of the notches has an open end at the spacer end positioned intermediate outbound edges of the root spacer and the at least one of the notches extends radially and axially into the root spacer, and one of the notches extends circumferentially within the root spacer; and wherein the grip element extends axially to the spacer end.

14. An assembly with an axis, comprising:

a rotor disk including a slot that extends axially into the rotor disk;

a rotor blade including a blade root arranged within the slot; and a root spacer arranged with the slot between the rotor disk and the blade root, the root spacer extending axially to a spacer end and including a grip element and a plurality of notches;

wherein the grip element is arranged at the spacer end circumferentially between the notches, and at least partially defines the notches;

wherein at least one of the notches has an open end at the spacer end positioned intermediate outbound edges of the root spacer and the at least one of the notches extends radially and axially into the root spacer, and one of the notches extends circumferentially within the root spacer;

wherein the root spacer includes an inner surface and an outer surface;

wherein the inner surface is positioned next to the rotor disk;

wherein the outer surface is positioned next to the blade root; and wherein the root spacer is configured as a solid monolithic body such that material of the root spacer extends uninterrupted between the inner surface and the outer surface.

15. An assembly disposed along a longitudinal axis, comprising:

a rotor disk including a slot that extends axially into the rotor disk;

a rotor blade including a blade root arranged within the slot; and a root spacer formed of a single layer of material being axially arranged with the slot between the rotor disk and the blade root, the root spacer including an axial spacer end and at least two axial portions, the at least two axial portions including a generally planar spacer base portion in communication with one or more spacer side portions, the one or more spacer side portions each having an angularly disposed, non-parallel relationship to the spacer base portion, the spacer base portion generally disposed parallel to the longitudinal axis, and the spacer base portion including a grip element and defining a plurality of notches;

wherein the grip element is arranged in the spacer base portion at the axial spacer end, the grip element is circumferentially between the plurality of notches, and the grip element at least partially defines each notch of the plurality of notches; and wherein each notch of the plurality of notches extends radially and axially into the spacer base portion of the root spacer, and at least one of the plurality of notches extends circumferentially within the spacer base portion of the root spacer.

* * * * *